US011620971B2

(12) United States Patent
Humphreys

(10) Patent No.: US 11,620,971 B2
(45) Date of Patent: Apr. 4, 2023

(54) DRUM PRACTICE PAD

(71) Applicant: Simon Humphreys, Scarborough (GB)

(72) Inventor: Simon Humphreys, Scarborough (GB)

( * ) Notice: Subject to any disclaimer, the term of this patent is extended or adjusted under 35 U.S.C. 154(b) by 0 days.

(21) Appl. No.: 17/408,540

(22) Filed: Aug. 23, 2021

(65) Prior Publication Data

US 2022/0068246 A1 Mar. 3, 2022

(30) Foreign Application Priority Data

Aug. 28, 2020 (GB) ..... 2013595

(51) Int. Cl.
*G10D 13/03* (2020.01)
*G10D 13/18* (2020.01)

(52) U.S. Cl.
CPC ..... *G10D 13/03* (2020.02); *G10D 13/18* (2020.02)

(58) Field of Classification Search
CPC ..... G10D 13/03; G10D 13/18; G10D 13/00
See application file for complete search history.

(56) References Cited

U.S. PATENT DOCUMENTS

2018/0137843 A1 5/2018 Roderick
2020/0273437 A1 8/2020 Lin

FOREIGN PATENT DOCUMENTS

CN 108062942 A 5/2018
CN 109859726 A 6/2019
CN 109859726 A * 6/2019 ..... G10D 13/03

OTHER PUBLICATIONS

UKIPO Search Report under Section 17(5) for Aapplication No. GB2013595.0 dated Feb. 25, 2021 (3 Pages).

* cited by examiner

*Primary Examiner* — Kimberly R Lockett
(74) *Attorney, Agent, or Firm* — Bejin Bieneman PLC

(57) ABSTRACT

According to an aspect of the present disclosure there is provided a practice pad for practising the use of a snare drum. The practice pad includes: an upper drum surface; and a sound generating device arranged below the drum surface. The sound generating device includes: a chamber having a first surface and an opposing second surface; and a plurality of elongate rods retained inside the chamber, between the first and second surfaces, so that the plurality of elongate rods vibrate against the first and second surfaces in response to a strike of the drum surface.

20 Claims, 6 Drawing Sheets

DRUM PRACTICE PAD

CROSS-REFERENCE TO RELATED APPLICATIONS

This application claims priority to United Kingdom Patent Application No. GB 2013595.0, filed on Aug. 28, 2020, which application is hereby incorporated herein by reference in its entirety.

FIELD OF THE DISCLOSURE

This disclosure generally relates to a musical instrument and, in particular, to a practice pad, or apparatus, for practising the use of a snare drum.

BACKGROUND

Practice pads are known in the art for practicing drumming technique. Typically, a practice pad is a discoidal device designed to replicate the feel of an ordinary drum, while producing a relatively muted sound output when struck. Unlike an ordinary drum, the practice pad is therefore suitable for quiet practice sessions.

Practice pads are often designed for portability and may be placed on nearly any underlying surface, including the drumhead of an ordinary drum, which provides the user with more opportunities to practice away from a studio.

However, an issue with conventional practice pads is that they are unable to adequately reproduce the distinctive sound of a snare drum, which includes a staccato sound produced by a metallic snare. Without suitable acoustic feedback, it is difficult for a user to know if they are practising the correct rhythmic drumming technique required to play a snare drum effectively.

It is against this background that the disclosure has been devised.

SUMMARY OF THE DISCLOSURE

According to a first aspect of the disclosure, there is provided a practice pad for practising the use of a snare drum. The practice pad comprises: an (upper) drum surface; and a sound generating device (arranged below the drum surface). The sound generating device comprises: a chamber having a first surface and an opposing second surface; and a plurality of elongate rods retained inside the chamber, between the first and second surfaces, so that the plurality of elongate rods vibrate against the first and second surfaces in response to a strike of the drum surface.

By virtue of this arrangement, the practice pad is able to accurately replicate the sound, and particularly the tone, of an ordinary snare drum, with the sound generating device adding the staccato sound normally produced by a metallic snare. Consequently, the practice pad provides a user with enhanced acoustic feedback, enabling a user to develop the correct rhythmic drumming technique required to play a snare drum effectively.

It shall be appreciated that, in ordinary use, the drum surface is an upper drum surface and the sound generating device is arranged below the upper drum surface so that vibrations are transmitted through the practice pad to the sound generating device when the upper drum surface is struck, thereby causing the plurality of elongate rods to vibrate against the first and second surfaces. However, the practice pad is not limited to use in such an orientation and it shall be appreciated that, in other orientations, the sound generating device may be described as being arranged beside, adjacent, or otherwise proximal, to the drum surface so as to receive such vibrations when the drum surface is struck.

In an example, at least one of the first surface, and/or the second surface, of the chamber is a non-planar surface. The non-planar surface may provide distinct points of contact with the plurality of elongate rods, as opposed to a uniform engagement, which may help to produce the short, sharp, sound of an ordinary snare. In an example, the non-planar surface may be a domed surface, or an undulating surface.

The plurality of elongate rods may be arranged so as to extend across the one or more undulations of the undulating surface. In this manner, the plurality of elongate rods may be supported across the undulations with the plurality of elongate rods arranged to vibrate against the peaks, or troughs, of the undulations, for example.

Optionally, the undulating surface may be a corrugated surface. Accordingly, the undulations may comprise a series of ridges or grooves.

At least one of the first surface, and/or the second surface, of the chamber may be metallic. Optionally, at least one of the first surface, and/or the second surface, of the chamber is steel. Advantageously, the vibration of such metallic surfaces is suitable for producing a sound substantially matching that of an ordinary snare.

In an example, the first and second surfaces of the chamber are configured to abut against the plurality of elongate rods with one or more of the plurality of elongate rods arranged in contact with both the first and second surfaces of the chamber. In this manner, the plurality of elongate rods and the first and second surfaces may vibrate against one another to produce the sound of an ordinary snare.

Optionally, the practice pad includes a first panel that defines the second surface of the chamber. The first surface may be defined by another surface of the practice pad, such as a surface of a structural body of the practice pad, and the first panel may be conveniently supported on the practice pad to define the opposing second surface. The first panel may be an undulating panel, such as a corrugated panel.

The practice pad may include a second panel that defines the first surface of the chamber. In this manner, the plurality of elongate rods may be arranged between opposing surfaces of the first and second panels. Optionally, the first panel, and/or the second panel, may be made of steel, carbon steel, brass, bronze, or nylon, for example.

The first panel, the second panel and the plurality of elongate rods may be individually movable with respect to one another in a first direction, extending from the first surface to the second surface of the chamber. The first panel, the second panel and the plurality of elongate rods may also be configured to vibrate in that direction in response to a strike of the drum surface.

The practice pad may include retaining means configured to constrain the movement of the first panel with respect to the second panel, and thereby to retain the plurality of elongate rods between the first and second panels. Such retaining means may take the form of a set of fastening elements, for example.

In an example, the plurality of elongate rods are coplanar with one another inside the chamber. The plurality of elongate rods may be arranged substantially parallel to one another.

In an example, the plurality of elongate rods may be densely packed together, side-by-side, so as to press against one another inside the chamber. In this manner, the plurality of elongate rods may bear against one another to maintain the plurality of elongate rods in substantial alignment with one another and/or to inhibit rotation, and/or lateral movement, of the plurality of elongate rods.

One or more of the plurality of elongate rods may extend at least halfway across the first surface, and/or the second surface, of the chamber. The length of the plurality of elongate rods may contribute to the ability of the plurality of elongate rods to produce the short, sharp, sound of an ordinary snare.

Optionally, one or more of the plurality of elongate rods are metallic. For example, one or more of the plurality of elongate rods may be made of steel. Such steel rods are configured to produce a sound that substantially matches that of an ordinary snare. Optionally, the plurality of elongate rods may be made of carbon steel, brass, bronze, or nylon for example.

One or more of the plurality of elongate rods may be solid cylindrical rods. Solid cylindrical rods may have suitable density to vibrate so as to produce the short, sharp, sound of an ordinary snare.

The plurality of elongate rods may have a length of at least 100 mm, e.g., at least 150 mm. For example, the plurality of elongate rods may have a length of 160 mm. The plurality of elongate rods may also have a diameter of less than 5 mm, e.g., less than 2 mm. For example, the plurality of elongate rods may have a diameter of 1 to 1.2 mm. Furthermore, the plurality of elongate rods may have an aspect ratio, between the diameter of the rods and the length of the rods, of at least 50:1, e.g., at least 100:1, although may be up to 130:1 or more. The plurality of elongate rods may include at least 50 rods, e.g., at least 60 rods and may include at least 80 rods. It will be appreciated that these values are exemplary in nature and are not limiting to the inventive concept.

In an example, the first surface of the chamber is an upper surface of the chamber arranged in a lateral plane, parallel to the drum surface, and the second surface of the chamber is an opposing lower surface of the chamber. In this manner, the plurality of elongate rods may vibrate in a vertical direction against the opposing surfaces of the chamber.

Optionally, at least one of the first surface, and/or the second surface, is concentric with the drum surface. Advantageously, such a concentric arrangement may enhance the sensitivity of the sound generating device to peripherical strikes of the drum surface.

In an example, at least one of the first surface, and/or the second surface, of the chamber may extend under at least 50% of a lateral area defined by the drum surface, e.g., extending under at least 60% of the lateral area defined by the drum surface. In this manner the sound generating device extends under a major portion of the drum surface, enhancing the sensitivity of the sound generating device to peripherical strikes of the drum surface.

Optionally, the sound generating device is arranged in a cavity of the practice pad. For example, the cavity may be defined by a recess in an underside of the practice pad. The recess may provide a convenient space for retaining the sound generating device within a structural body of the practice pad, whilst allowing the sounding generating device to project sound outward from the underside of the practice pad.

In an example, the recess may define a shape in the underside of the apparatus that is one of: rectangular, optionally, square-shaped; circular; annular; triangular; hexagonal; or octagonal. The recess may define a shape in the underside of the apparatus corresponding to a shape of the drum surface.

In an example, the practice pad may further comprise: a resilient drumming pad; and a (solid) structural body. The resilient drumming pad may be mounted on an upper surface of the structural body and an upper surface of the resilient drumming pad may define the drum surface. Accordingly, the sound generating device may be attached to the structural body below the resilient drum pad.

In an example, the structural body may be made of a solid material configured to transfer vibrations, arising from a strike of the drum surface, through to the sound generating device, optionally, the structural body may be wooden.

In an example, the practice pad further comprises a rim received in a recess on the upper surface of the structural body. The rim may extend around the drum surface to provide a raised playing edge.

In an example, the practice pad may further comprise a resilient support pad, arranged on the lower surface of the structural body. The support pad may provide a skid-resistant surface for maintaining the apparatus in position, in use, on an underlying surface.

Within the scope of this disclosure it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

The above and other aspects of the disclosure will now be described, by way of example only, with reference to the accompanying drawings, in which.

In the drawings, the same reference numerals are used to denote features that are common across drawings.

SPECIFIC DESCRIPTION

Embodiments of the disclosure relate to an apparatus, or practice pad, for practising the use of a snare drum. The practice pad is principally configured to reproduce the characteristic sound of an ordinary snare drum accurately, but with a relatively muted sound output.

For this purpose, the practice pad includes a sound generating device comprising a chamber having a plurality of elongate rods arranged between a pair of opposing surfaces. The sound generating device is configured to produce snare-like sound in response to drumming, i.e., a sound substantially matching that of a snare of an ordinary snare drum. The inventor has found that the plurality of elongate rods are particularly effective vibrating intermediaries, capable of producing the snare-like sound, when arranged to vibrate between the pair of opposing surfaces.

By virtue of this arrangement, the practice pad is able to accurately replicate the sound, and particularly the tone, of an ordinary snare drum. Hence, the practice pad provides a user with enhanced acoustic feedback, enabling a user to develop the correct rhythmic drumming technique required to play a snare drum effectively.

Figure 1:
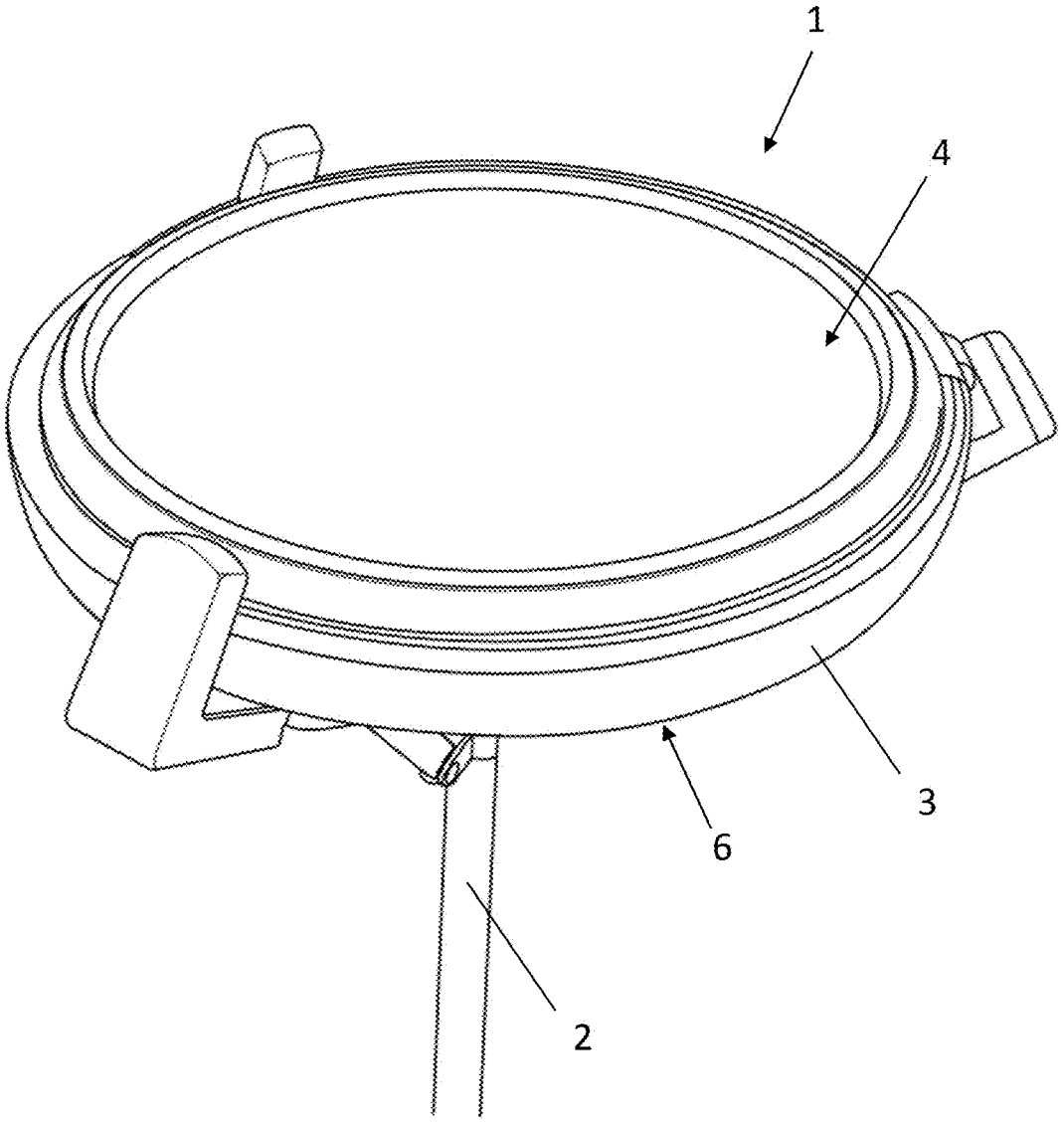
FIG. 1 is an illustration of an example practice pad in accordance with an embodiment of the disclosure.

FIG. 1 shows a perspective view of an example practice pad 1 in accordance with an embodiment of the disclosure.

In this example, the practice pad 1 is illustrated in-situ, mounted on a stand 2 that supports the practice pad 1 at a suitable height and/or orientation for use. As shall become clear, although convenient, the practice pad 1 is not limited to use on the stand 2 and may, in fact, be used on nearly any underlying surface, including a drumhead of an ordinary drum.

The practice pad 1 is generally discoidal and, in this example, the practice pad 1 has a substantially flat cylindrical shape, largely defined by a structural body 3 that extends along a longitudinal axis of the practice pad 1 from a first surface 4 to an opposing second surface 6.

In use, the practice pad 1 is generally oriented as shown in FIG. 1, such that the first surface 4 of the structural body 3 forms an upper surface of the practice pad 1 and the second surface 6 of the structural body 3 forms an opposing lower surface of the practice pad 1.

However, the practice pad 1 is not limited to such orientation and it will be appreciated that corresponding references, such as above, below, upper, lower, upward and downward, in the following description only refer to the orientation of the practice pad 1 as shown in the illustrations which, moreover, corresponds to its orientation in normal use. Hence, such references are not intended to be limiting on the scope of the disclosure.

The structural body 3 may be made of various suitable materials that provide desirable acoustic characteristics with suitable structural integrity and resilience. For example, the structural body 3 may be made from a metal, wood, plastic, or composite material that transmits vibrations through the practice pad 1 effectively.

The practice pad 1 may be generally thin, as shown in FIG. 1, for example having a thickness of less than approximately 50 mm between the upper and lower surfaces 4, 6. In this example, the practice pad 1 has a thickness of approximately 40 mm. The practice pad 1 may also be lightweight, for example having a weight of less than 4 kg, e.g., less than 3 kg, and may even be less than 2 kg. Although such dimensions and properties are not essential to the operation of the practice pad 1 as an apparatus for practising the use of a snare drum, they may ensure that the practice pad 1 is a portable article that is easily transportable. For example, the structural body 3 may be made of a lightweight, low-density material that contributes to the portability of the practice pad 1. For example, the structural body 3 may be made of a low-density wood, such as poplar wood, or a medium-density fibreboard, that transmits vibrations through the practice pad 1 effectively.

Figure 2:
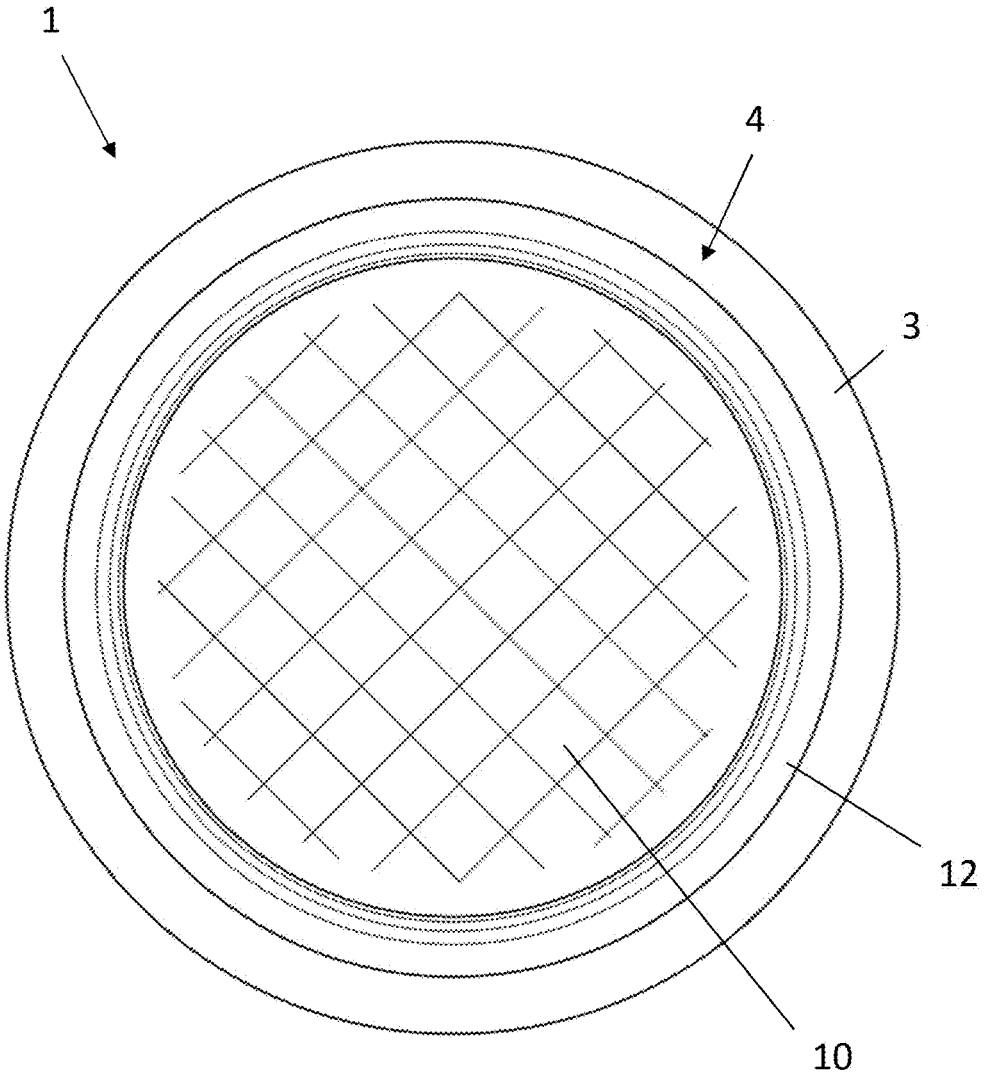
FIG. 2 is a top view of the practice pad shown in FIG. 1.

FIG. 2 shows a plan view of the practice pad 1, illustrating the upper surface 4 of the practice pad 1.

As shown, the upper surface 4 of the practice pad 1 includes a drum surface 10, or primary playing surface, and a rim 12 that extends around the drum surface 10 on the underlying structural body 3.

The drum surface 10 is configured to replicate the feel, response, and/or aesthetic, of an ordinary drumhead, or drumskin, but produces a relatively muted sound output when struck by a drumstick. In this manner, the practice pad 1 may be more appropriate for quieter practice sessions.

For this purpose, it shall be appreciated that the drum surface 10 may be formed of a suitable resilient material that will provide the feel of an ordinary drumhead, but respond with a quieter sound output. For example, the drum surface 10 may be formed of a suitable elastomer, such as rubber, a disk of mylar, or any other conventional drumhead material that provides a suitable playing surface. It is well-known in the art for the drum surface to be defined on a surface of a pad of such resilient material, often referred to as a drumming pad, that may be removed, and/or replaced, for example for repair.

The shape of the drum surface 10 typically corresponds to the shape of the practice pad 1 and may be circular, as shown in this example, to replicate the feel and/or aesthetic of an ordinary snare drum. However, it is not essential that the drum surface is circular and, in other examples, the drum surface 10 may be rectangular, hexagonal, octagonal or any other suitable shape. The size of the practice pad 1 may correspond to an ordinary snare drum or a particular type of snare drum, such as a micro snare drum or a ballad snare drum. For context, the drum surface 10 may have a diameter between 15 cm and 40 cm, for example.

The practice pad 1 may include the rim 12 to replicate the feel, response, and/or aesthetic, of an ordinary drum rim. Accordingly, the rim 12 may extend around a perimeter of the drum surface 10 and protrude outwardly beyond the drum surface 10 to provide a raised edge like an ordinary drum rim. In this manner, the rim 12 may provide an alternative, or secondary, playing surface, like the rim of an ordinary snare drum, that may be struck alone, to produce a rim-click sound, or in combination with the drum surface 10, to produce a rimshot sound.

For this purpose, the rim 12 may be formed of any suitable material configured to reproduce the sound output of an ordinary snare drum rim, or a relatively muted version of that sound output, when struck by a drumstick. For example, the rim 12 may be formed of a solid material, such as wood, plastic, or metal, as is well-known in the art. Additionally, or alternatively, the rim 12 may be formed of, or otherwise include a layer of, relatively flexible, and/or resilient material, such as those resilient materials identified above, configured to produce a relatively dampened sound output.

For example, it is well-known in the art for the rim to be defined by a raised edge of an annular ring that may be removable from the practice pad 1, and/or replaceable, for example for repair or adjustment. The ring may be formed from a solid, rigid, material coated with an outer layer of resilient material surface configured to produce a quieter sound output.

Figure 3:
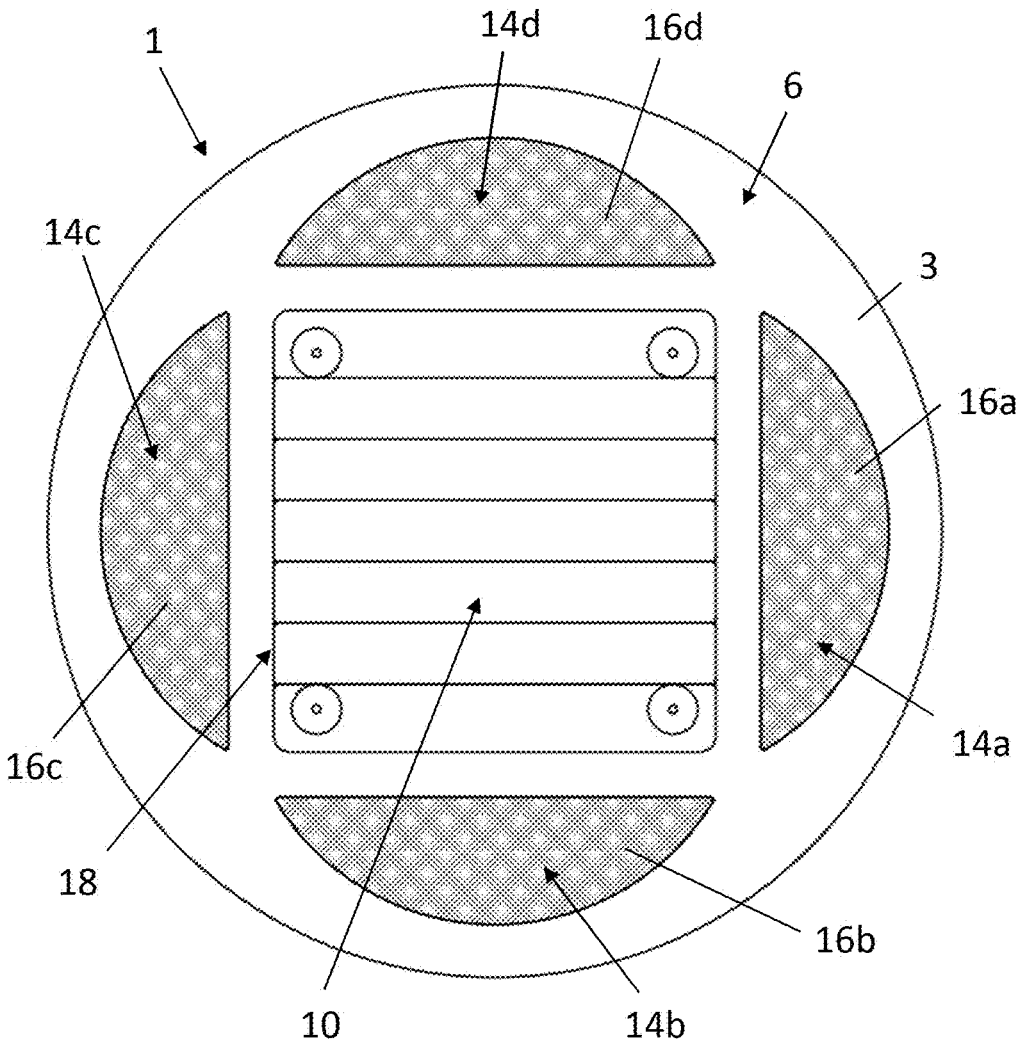
FIG. 3 is a bottom view of the practice pad shown in FIG. 1.

FIG. 3 shows a bottom view of the practice pad 1, depicting the second surface 6 which defines the underside of the practice pad 1.

As shown from this view, the practice pad 1 includes a plurality of support pads 14*a-d* and a sound generating device 16.

The sound generating device 16 is configured to output sound that is substantially snare-like and, through extensive experimentation, the inventor has found that the sound generating device 16 may be optimised for this purpose by arranging a plurality of elongate rods between a pair of opposing chamber surfaces, where the plurality of elongate rods are configured to vibrate against the opposing surfaces in response to a strike of the drum surface. Accordingly, in embodiments of the disclosure, the sound generating device 16 may take one or more suitable forms, each having a chamber in which a plurality of elongate rods are arranged to vibrate against a pair of opposing surfaces to produce the snare-like sound, as shall become clear.

As shown in FIG. 3, the sound generating device 16 may be arranged below the drum surface 10 in a position that is readily excitable by a strike of the drum surface 10. For example, the sound generating device 16 may be arranged in an underside recess 18 defined in the lower surface 6 of the structural body 3. The underside recess 18 may take a range of suitable shapes for receiving the sound generating device 16 and, as shown in FIG. 3, the underside recess 18 may form a rectangular depression in the structural body 3 that plateaus to define a floor (not shown) of the recess 18. The underside recess 18 may allow the sound generating device 16 to be arranged in close proximity to the drum surface 10, whilst ensuring that the sound generating device 16 is open to the exterior and able to project sound effectively from the underside 6 of the practice pad 1.

This arrangement is not intended to be limiting though and, in other examples, the sound generating device 16 may be attached to the practice pad 1 in one of various suitable arrangements that produce a desirable sound output. For example, the sound generating device 16 may be arranged within the structural body 3, or attached thereto, in other suitably excitable arrangements in which the sound generating device 16 may be arranged proximal, or adjacent, to the drum surface 10 so as to produce the snare-like sound when the drum surface 10 is struck.

In order to optimise the sensitivity of the sound generating device 16 to a strike of the drum surface 10, and/or the rim 12, the sound generating device 16 may be arranged concentrically with the drum surface 10, as shown in FIG. 3. The sound generating device 16 may also extend, or span, underneath a significant proportion of the drum surface 10. In other words, a centre of the drum surface 10 may be aligned with a lateral centre of the sound generating device 16 and the sound generating device 16 may extend underneath more than half of the area defined by the drum surface 10. The sound generating device 16 may extend underneath at least 60% of the lateral surface area defined by the drum surface 10. In this manner, vibrations of the drum surface 10 are encouraged through to the sound generating device 16 and the practice pad 1 is advantageously configured to produce the snare-like sound, even when the peripheries of the drum surface 10, or indeed the rim 12, are struck by a drumstick. In contrast, conventional practice pads typically produce a muted, or otherwise sub-optimal, sound output when struck off-centre. It shall be appreciated that the sound generating device 16 may therefore have a width, length, and/or span corresponding to the drum surface 10 in order to provide the desired vibrational sensitivity.

The sound generating device 16, and its operation, shall be described in more detail in later parts of the description.

The plurality of support pads 14*a-d*, shown in FIG. 3, are not essential to the disclosure but may be provided on the underside of the practice pad 1 to facilitate the use of the practice pad 1 on a wide range of underlying surfaces. For example, the support pads 14*a-d* may facilitate the use of the practice pad 1 on the drumhead of an ordinary drum.

For this purpose, the plurality of support pads 14*a-d* may include skid-resistant lower surfaces 18*a-d* that engage the underlying surface and substantially inhibit lateral movement of the practice pad 1 in use. For example, the plurality of support pads 14*a-d* may be made of a high-friction, flexible, and/or resilient material, such as rubber or sponge. Advantageously, when drumming on the practice pad 1, the resilient nature of the support pads 14*a-d* may dampen the forces transmitted through to the underlying surface, minimising any extraneous sources of noise.

The plurality of support pads 22*a-d* may be arranged around the sound generating device 16 in a manner that provides suitable support, and the plurality of support pads 22*a-d* may be joined to the underside 4 of the practice pad 1 by various suitable means, including an adhesive for example.

In this example, the plurality of support pads 14*a-d* includes a first support pad 14*a*, a second support pad 14*b*, a third support pad 14*c*, and a fourth support pad 14*d* arranged in a rectangular formation around the sound generating device 16, as shown in FIG. 3. However, it shall be appreciated that this arrangement is not intended to be limiting and, in other examples, the practice pad 1 may include a different arrangement of one or more support pads around the sound generating device 16.

Figure 4:
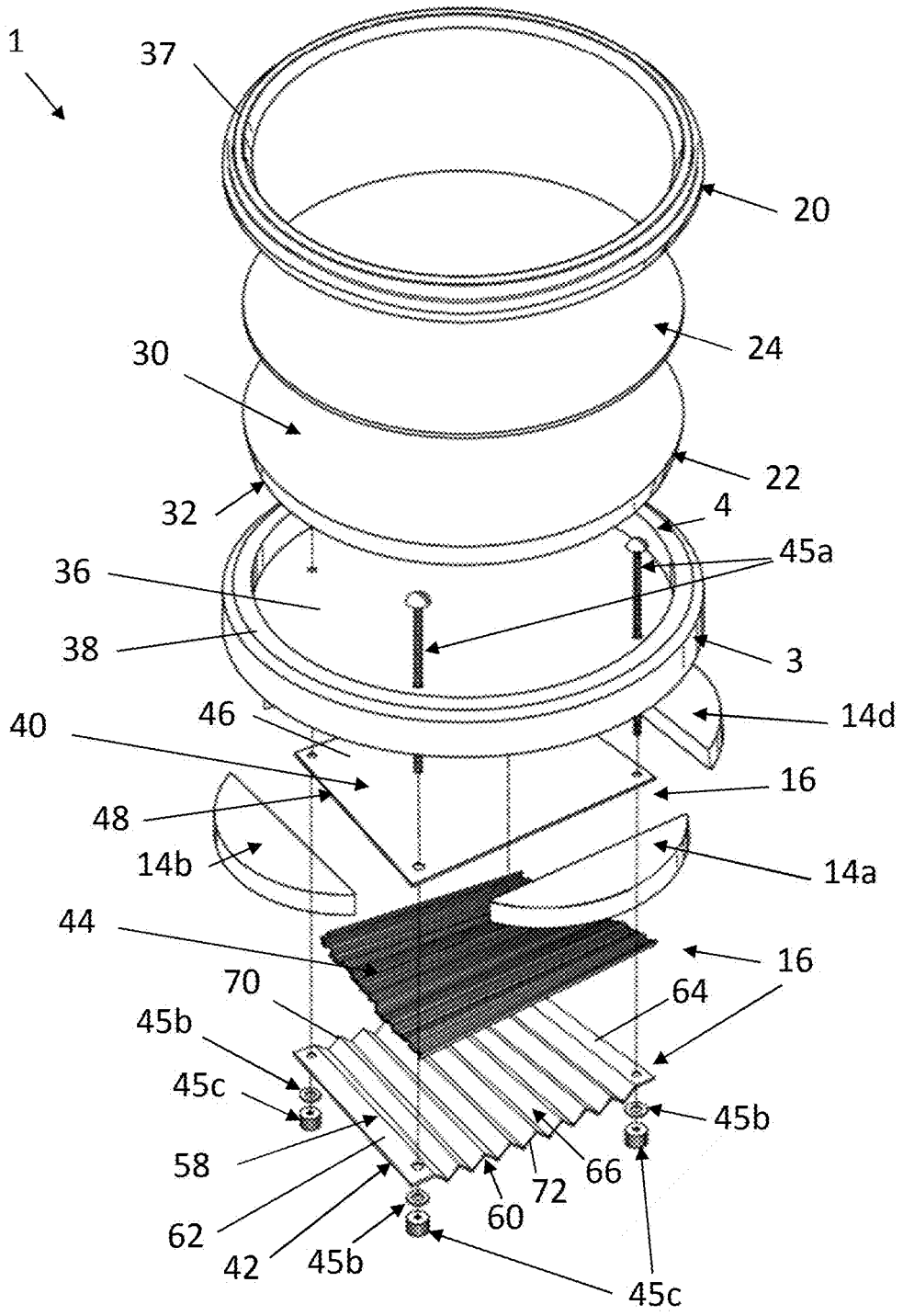
FIG. 4 is an exploded assembly view of the practice pad shown in FIG. 1.

FIG. 4 shows the practice pad 1 as an assembly (illustrated by an exploded schematic view) comprising: a ring 20 that defines the rim 12; a drumming pad 22 that defines the drum surface 10; a sheet of laminating material 24; the structural body 3; the plurality of support pads 14*a-d* and the sound generating device 16.

Although the practice pad 1 is shown as an assembly in FIG. 4, it shall be appreciated that, in other examples, two or more of the above elements of the practice pad 1 may be formed integrally with one another. For example, the structural body 3 may be formed integrally with the rim 12, the rim 12 being defined by a raised edge of the structural body 3.

The drumming pad 22 may provide a removable and/or replaceable element that defines the drum surface 10. Accordingly, the drumming pad 22 may be generally discoidal and cylindrical, as shown in FIG. 4, extending from a first surface 30, which defines the drum surface 10 of the practice pad 1, to an opposing second surface 32 that may define an underside of the drumming pad 22. It shall be appreciated that the cylindrical shape of the drumming pad 22 is not intended to be limiting on the disclosure but, in this example, the cylindrical shape conveniently defines the circular drum surface 10.

As alluded to previously, the drumming pad 22 may be made of a resilient material, such as rubber, or otherwise include a layer of such resilient material on the first surface 30, which produces a dampened sound output when struck.

The upper surface 4 of the structural body 3 may include an upper side recess 36 that is complementary to the drumming pad 22 and suitable for receiving the drumming pad 22, as shown in FIG. 4. Accordingly, the upper side recess 36 may correspond to the shape of the drumming pad 22 and may be cylindrical, as shown in this example.

The sheet of laminating material 24 is not essential to the disclosure but may be joined to the drumming pad 22, for example by an adhesive, to provide an alternative, or customisable, aesthetic surface coating. Accordingly, the sheet of laminating material 24 may be configured to cover at least a portion of the first surface 30 of the drumming pad 22 (i.e.

the drum surface 10) and may include any suitable print and/or texture that replicates the feel and/or appearance of an ordinary drumhead or drum skin. For example, the sheet of laminating material 24 may take the form of a vinyl graphic laminate.

The ring 20 take the form of a removable, and/or replaceable, element that defines the rim 12. Accordingly, the ring 20 may take various suitable shapes that taper into an upper edge 37 defining the rim 12 on the upper surface 4 of the practice pad 1. As alluded to previously, the ring 20 may therefore be made of a resilient material, such as rubber, or otherwise include a layer of such resilient material on the upper edge 37. Such resilient material may produce a dampened sound output when struck.

The upper surface 4 of the structural body 3 may also include a groove 38 that is complementary to, and suitable for receiving, the ring 20, as shown in FIG. 4. Accordingly, the groove 38 may extend around a perimeter of the upper side recess 37 to define an annular shape for receiving the ring 20, as shown in FIG. 4.

In this example, the sound generating device 16 includes a first panel 40, a second panel 42 and a plurality of elongate rods 44 that are arranged between the first and second panels 40, 42 to define a chamber.

The sound generating device 16 is attached to the practice pad 1 in a manner that allows little more than vibrational movement of the first and second panels 40, 42 and the plurality of elongate rods 44 and, in this example, the sound generating device 16 is held together and joined to the practice pad 1 by a set of fastening elements 45*a-c*. The set of fastening elements 45*a-c* are configured to couple the sound generating device 16 to the structural body 3 and effectively retain the sound generating device 16 in the underside recess 18, allowing no more than vibrational movement of sound generating device 16. It shall be appreciated that the set of fastening elements 45*a-c* may take various suitable forms for this purpose but, in this example, the set of fastening elements includes a set of bolts 45*a*, a set of washers 45*b* and a set of nuts 45*c*.

Figure 5:
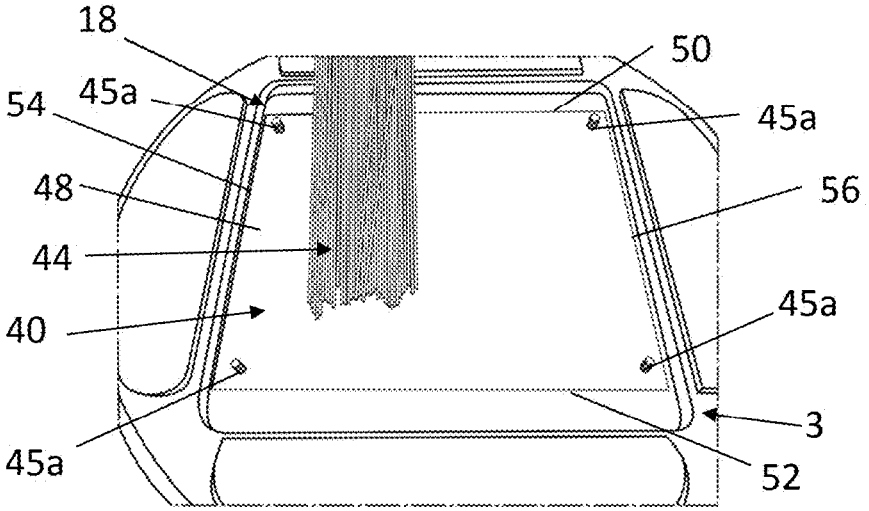
FIGS. 5 to 7 illustrate the practice pad, shown in FIG. 1, in successive state of partial assembly.
Figure 6:
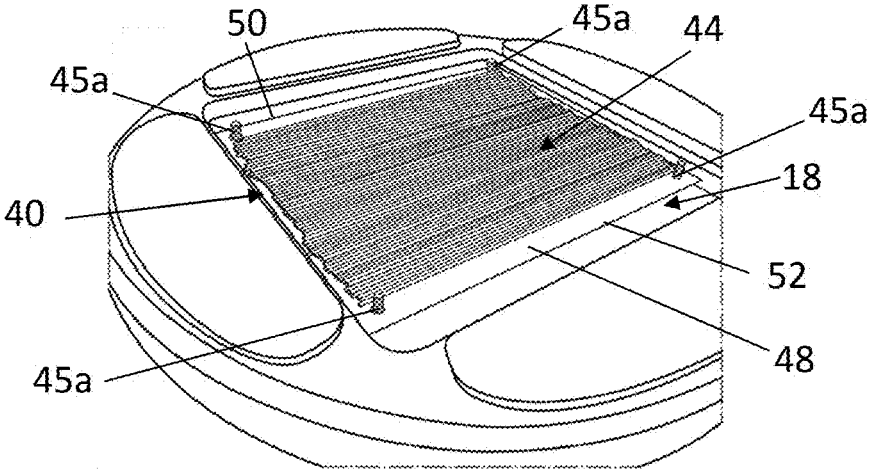
Figure 7:
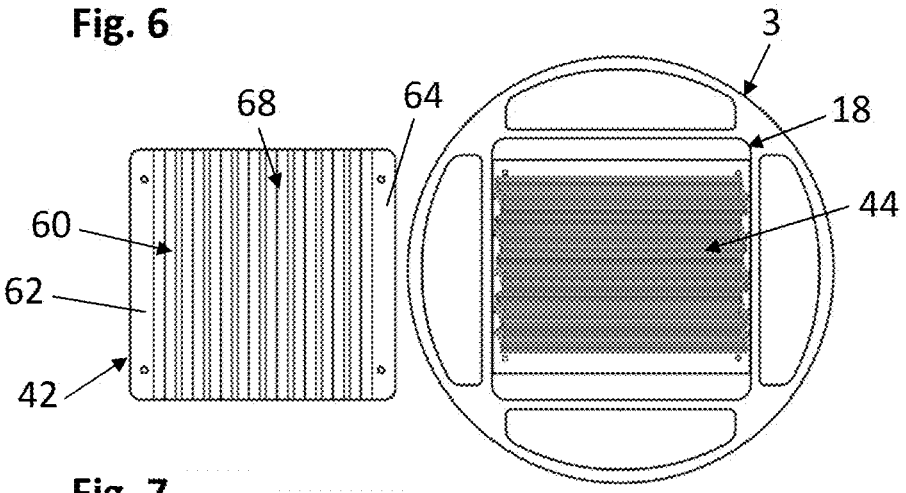

The sound generating device 16 shall now be considered in more detail with additional reference to FIGS. 5 to 7, which shows the underside 6 of the practice pad 1 with the sound generating device 16 in successive states of partial assembly.

As shown in FIGS. 4 and 5, the first panel 40 is substantially planar having a first surface 46 and an opposing second surface 48. Generally, the first panel 40 is relatively thin, and it is envisaged that it should be approximately 0.5 to 2 mm in thickness, and may be in the range of 0.8 to 1 mm in thickness.

In this example, the first panel 40 of the sound generating device 16 is received in the underside recess 18 so that the first surface 46 of the first panel 40 faces the floor of the recess 18 and the second surface 48 of the first panel 40 defines an upper surface of the chamber of the sound generating device 16, as shown in FIG. 5.

Accordingly, the first panel 40 is rectangular in this example, corresponding to the shape of the underside recess 18, and extends from a first end 50 to an opposing second end 52, having a width arranged between a first side 54 and an opposing second side 56. The first panel 40 may substantially span across the length and width of the floor of the underside recess 18, as shown in FIG. 5.

The first panel 40 is retained in position in the underside recess 18 by the set of bolts 45*a*, which extend through respective holes in the first panel 40 to locate the first panel 40 and substantially inhibit lateral movement of the first panel 40 within the underside recess 18.

As shown in FIGS. 4 and 7, the second panel 42 is corrugated, in this example, and includes a first surface 58 and an opposing second surface 60. The second panel 42 is also thin and it is envisaged that the second panel 42 may have a thickness of approximately 0.5 to 2 mm in thickness, and may be in the range of 0.8 to 1 mm in thickness.

The second panel 42 is received in the underside recess 18 so that the first surface 58 of the second panel 42 defines a lower surface of the chamber of the sound generating device 16 and the second surface 60 of the second panel 42 faces the opening of the underside recess 18, forming an exterior surface of the practice pad 1. Accordingly, the second panel 42 may also be substantially rectangular, as shown in FIG. 4.

In particular, the second panel 42 may extend from a first end 62 to a second end 64 and the first surface 58 may features a series of undulations, such as the grooves 66 shown in FIG. 4, whilst the second surface 60 may features a corresponding series of undulations, such as the ridges 68 shown in FIG. 7. The series of grooves 66 and corresponding ridges 68 may extend in parallel across a width of the second panel 42, from a first side 70 to a second side 72, between the first and second ends 62, 64 of the second panel 42. However, the second panel 42 is substantially planar at the first and second ends 62, 64, with the first and second surfaces 58, 60 being substantially flat. As shall become clear, the flat surfaces are suitable for the set of fastening elements 66*a-c* to bear against and retain the second panel 42 in position.

Turning now to the plurality of elongate rods 44, the inventor has found that elongate rods are particularly effective vibrating intermediaries, capable of producing short, sharp, notes when arranged to vibrate between a pair of opposing surfaces, such as those provided by the first and second panels 40, 42. In contrast to granular elements, such as beads and pellets, each elongate rod is generally heavier and more elongate and vibrates for a shorter period as a result. Such short, sharp, notes are characteristic of a snare of an ordinary snare drum and, in this manner, the vibration of the plurality of elongate rods 44 against the pair of opposing surfaces adds to the staccato sound.

As shown in FIG. 4, the plurality of elongate rods 44 may substantially match one another. For example, the plurality of elongate rods 44 may be substantially uniform in size, having the same, or similar, cross-sectional dimensions, and/or extending the same, or similar, lengths.

In this example, the plurality of elongate rods 44 are substantially cylindrical and solid. However, this is not essential to the disclosure and, in other examples, the plurality of elongate rods 44 may be tubular and/or the plurality of elongate rods may have a rectangular, triangular, hexagonal or other suitable cross-section. Tubular, i.e. hollow, rods may reduce the mass of the practice pad 1, but it shall be appreciated that different shape rods may produce different tones.

The plurality of elongate rods 44 are received in the underside recess 18 between the first and second panels 40, 42 so as to be retained inside the chamber and arranged to vibrate against the opposing upper and lower surfaces 48, 56 of the chamber (defined by the first and second panels 40, 42 in this example). For example, the plurality of elongate rods 44 may be spread out in a layer across the first panel 40 and may extend between the set of bolts 45*a*, as shown in FIG. 6, or across the span of the first panel 40.

In this example, the plurality of elongate rods 44 are uncoupled from one another, but may be arranged substantially parallel to one another inside the sound generating device 16. For example, as shown in FIG. 6, the plurality of elongate rods 44 may be packed together with sufficient density so as to bear against each other, limiting their lateral movement. For example, the plurality of elongate rods 44 may be arranged side-to-side between sides of the underside recess 18, or between the set of bolts 45*a*, with sufficient density to maintain the plurality of elongate rods substantially parallel to one another, for example varying by less than 5 degrees from a common axis.

To give some examples, the plurality of elongate rods 44 may include 50 elongate rods, each having a diameter of approximately 2 to 2.4 mm arranged between the set of bolts 45*a*, which may be spaced approximately 120 mm apart.

Fewer elongate rods 44 may generally yield a tighter, snappier response to a strike of the drum surface 10, whilst more elongate rods 44 may create a slower response and greater resonance, for example with more "fuzz" or "jangle". For context, the number of elongate rods 44 number may be in the range from 40 and 80 rods, but generally not more than 100 rods.

In another example, the plurality of elongate rods 44 may include 60 to 80 elongate rods, each having a diameter of approximately 1.2 mm to 1.5 mm arranged between the set of bolts 45*a* spaced approximately 120 mm apart.

Thereafter the second panel 42 may be received in the underside recess 18 so as to cover the plurality of elongate rods 44 and seal the underside recess 18. The second panel 42 may be oriented so that the series of grooves 66 extend orthogonally to the plurality of elongate rods 44 and the set of bolts 45*a* may extend through respective holes in the second panel 42 to locate the second panel 42 within the underside recess 18.

As shall become clear, the length of the plurality of elongate rods 44 may correspond to the span of the series of grooves 66, between the first and second ends 62, 64, as shown in FIG. 7, so that the plurality of elongate rods 44 extend across the series of grooves 66.

For context, the plurality of elongate rods 44 may have a length of at least 100 mm, e.g., at least 150 mm. In this manner, when suitably arranged, the plurality of elongate rods 44 may extend from the first end 62 of the second plate 42 to the second end 64 of the second plate 42. The plurality of elongate rods 44 may also have a diameter of less than 3 mm, e.g., less than 2 mm and may have a diameter of approximately 1.2 mm, or less, for example. Furthermore, the plurality of elongate rods 44 may have an aspect ratio, between the diameter of the rods 44 and the length of the rods 44, of at least 50:1, e.g., at least 100:1, and may even have an aspect ratio of more than 130:1.

Nonetheless, it shall be appreciated that the length, diameter and/or aspect ratio of the plurality of elongate rods 44 may correspond to the size of the drum surface 10 and/or the sound generating device 16. For example, the plurality of elongate rods 44 may be longer and thicker for use in a larger practice pad 1.

The practice pad 1 shall now be described in assembled form with reference to FIGS. 8 and 9.

Figure 8:
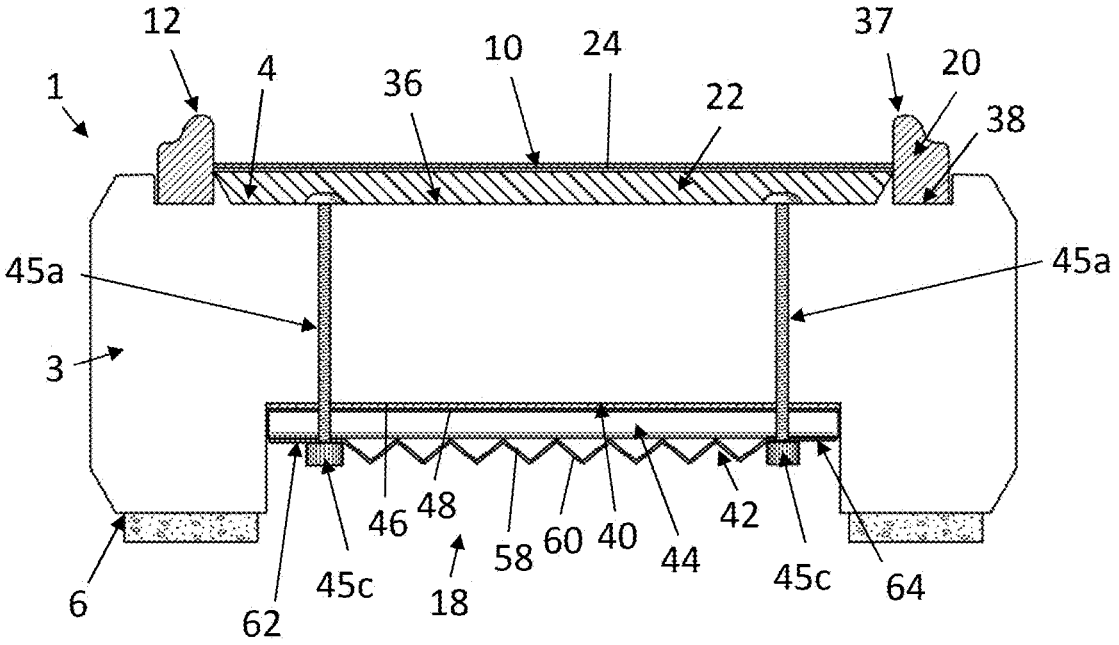
FIG. 8 shows a first cross-sectional view of the practice pad shown in FIG. 1.
Figure 9:
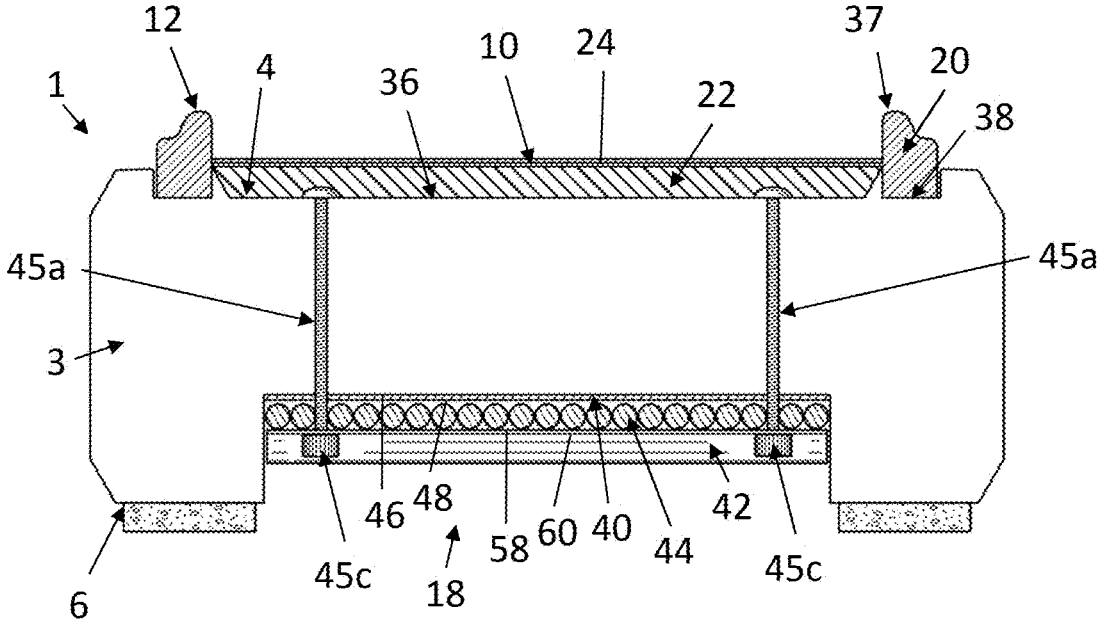
FIG. 9 shows a second cross-sectional view of the practice pad shown in FIG. 1, which is generally orthogonal to the view in FIG. 8.

FIG. 8 shows a first cross-sectional view of the practice pad 1 and FIG. 9 shows a second cross-sectional view of the practice pad 1, orthogonal to the first cross-sectional view.

As shown in FIGS. 8 and 9, the drumming pad 22 is received in the upper side recess 36 on the upper surface 4 of the structural body 3 and may be joined to the structural body 3, for example by an adhesive. The depth of the upper side recess 36 may correspond to a thickness of the drumming pad 22 so that the drumming pad 22 defines the drum surface 10 on the upper surface 3 of the practice pad 1. The ring 20 is received in the annular groove 38 on the upper surface 4 of the structural body 3 and may be joined to the structural body 3, for example by an adhesive. The depth of the groove 38 may correspond to a thickness of the ring 20 so that the upper edge 37 of the ring 20 defines the rim 12 on the upper surface 4 of the practice pad 1.

The set of bolts 45*a* may be received in respective holes in the structural body, with a bolt head of each bolt 45*a* forming a shoulder that bears against the upper surface 4 of the structural body 3, underneath the drumming pad 22. The set of bolts 45*a* may protrude into the underside recess 18, as shown, to join the sound generating device 16 to the structural body 3.

For example, the set of bolts 45*a* may extend through respective holes in the first and second panels 40, 42 and the set of nuts 45*c* may be screwed onto the ends of the set of bolts 45*a* so as to bear against the second surface 60 of the second panel 42, as shown in FIG. 8. The set of washers 70 may be arranged between the nuts 68 and the second panel 42, so that the set of washers 70 bear against the flat ends 58, 60 of the second panel 42 and retain the arrangement in the underside recess 18.

In this example, the set of nuts 45*c* are finger-tight on the set of bolts 45*a* so that there is sufficient clearance between the sound generating device 16 and the floor of the underside recess 18 to allow the first panel 40, the second panel 42 and the plurality of elongate rods 44 to vibrate against one another and the floor of the recess 18. Accordingly, the tightening of the nuts 45*c* may be limited to avoid clamping the sound generating device 16 too forcefully against the underside recess 18, thereby allowing the necessary vibrational movement to produce the snare-like sound.

In other examples, the sound generating device 16 may be held flush against the floor of the underside recess 18, and the plurality of elongate rods 44 may be able to vibrate against the first and second panels 40, 42 (in response to a strike of the drum surface 10) due to minor variations in the size of one or more of the plurality of elongate rods 44. For example, the diametric tolerance of the plurality of elongate rods 44 may be large enough to create enough clearance between the pair of opposing surfaces 48, 56 and at least one of the plurality of elongate rods 44, for those rod(s) 44 to vibrate.

As shown in FIGS. 8 and 9, the plurality of elongate rods 44 are arranged in a layer between the first and second panels 40, 42 and may extend substantially orthogonally to the direction of the series of grooves 66 and ridges 68 on the second panel 42. For example, the plurality of elongate rods 44 may extend from the first end 62 of the second panel 42 to the second end 64 of the second panel 42, as shown in FIG. 8. In this manner, the rods 44 may move within the chamber, but they will not rotate into alignment with the grooves 66. It has been found that the vibration of the plurality of elongate rods 44 against an undulating surface, such as the undulating surface defined by the series of grooves 66 on the first surface 56 of the second panel 42, produces particularly snare-like sound output.

In particular, in response to a strike of the drum surface 10, the plurality of elongate rods 44 vibrate against the first and second panels 40, 42 to produce a staccato sound that accompanies the sound output of the drum surface 10. The combined sound output substantially matches the sound output, and particularly the tone, of an ordinary snare drum, but the combined sound output is relatively quiet. Hence, the sound generating device 16 is principally responsible for the ability of the practice pad 1 to replicate the sound, and particularly the tone, of an ordinary snare drum, whilst enabling quiet practice.

For this purpose, the plurality of elongate rods 44, and/or the first and second panels 40, 42 may be made of various suitable materials for producing the snare-like sound. For example, the inventor has found that metallic panels 40, 42 in combination with metallic rods 44 are effective producers of the snare-like sound.

In an example, the plurality of elongate rods 44, the first panel 40 and the second panel 42 may be made of steel. The combination of steel plates 40, 42 and steel rods 44 provide a particularly effective arrangement for producing the snare-like sound. However, other combinations of materials may provide suitably effective arrangements and it is not essential to the disclosure that the plurality of elongate rods 44 and the first and second panels 40, 42 are made of the same material. For example, each of the plurality of elongate rods 44, the first panel 40 and the second panel 42 may be made of carbon steel, brass, bronze, or nylon in another example.

The illustrated embodiments discussed above demonstrate various technical implementations of the inventive concept. However, it will be appreciated by the skilled person that other variations may be made apart from those detailed above and yet still fall within the scope of the appended claims.

For example, although the practice pad 1 is cylindrical in this example, it shall be appreciated that the shape of the practice pad 1 is not intended to be limiting on the scope of the disclosure. In other examples, the practice pad 1 may define other suitable shapes, such as a rectangular shape, a hexagonal shape, an octagonal shape, or a triangular shape, as are common in the field of practice pads.

In another example, the plurality of elongate rods 44 may vary in size and/or shape so that the plurality of elongate rods vibrate across a range of frequencies, for example.

In the example described above, the sound generating device 16 is attached to the structural body 3 by a set of fastening elements 45*a-c*. However, it shall be appreciated that, in other examples, the sound generating device 16 may be joined to the structural body 3 by various retaining means that are configured to retain the sound generating device 16. Nonetheless, It shall be appreciated that such retaining means must allow the sound generating device 16 to vibrate.

In other examples, the opposing surfaces of the chamber of the sound generating device 16 may takes different forms. For example, one, or both, surfaces of the chamber may be defined by the structural body 3, as opposed to the first and/or second panels 40, 42 described above. Furthermore, in other examples, the first and second panels 40, 42 may take different forms. For example, the first and second panels 40, 42 may be planar, in another example, with the first and second surfaces 56, 58 of the second panel 42 being substantially flat. In another example, the second panel 42 may be an undulating panel, as in the example described above, but the undulation(s) may take other forms. For example the second panel 42 may include a single ridge or other formation. In another example, the second panel 42 may be domed so as to define curved first and second surfaces 56, 58. In this case, the plurality of elongate rods 44 may vibrate between the flat second surface 48 of the first panel 40 and the apex of the domed first surface 56 of the second panel 42. It has been found that each of these arrangements may be suitable for producing a snare-like sound.

In another example, the sound generating device 16 may be arranged inside the structural body 3. For example, the sound generating device 16 may take a form substantially as described above, but the sound generating device 16 may be slid into a cavity of the structural body 3 extending under the drum surface 10. For example, the first and second panels 40, 42 may be arranged on a tray, with the plurality of elongate rods 44 arranged therebetween, and the tray may be inserted into the cavity of the structural body 3 to move the sound generating device 16 into position.

In another example, the practice pad 1 may include a plurality of sound generating devices 16, substantially as described above, arranged under different areas of the drum surface 10. For example, a plurality of the sound generating devices 16 may be arranged to define a rectangular shape with one of the sound generating devices 16 arranged in a respective corner under the drum surface 10. The plurality of elongate rods 44 may be arranged obliquely to one another between respective ones of the sound generating devices 16.

The invention claimed is:

1. A practice pad for practising the use of a snare drum, the practice pad comprising:

an upper drum surface; and a sound generating device arranged below the drum surface;

wherein the sound generating device includes:

a chamber having a first surface and an opposing second surface; and a plurality of elongate rods retained inside the chamber, between the first and second surfaces, so that the plurality of elongate rods vibrate against the first and second surfaces in response to a strike of the drum surface.

2. A practice pad according to claim 1, wherein at least one of the first surface, and/or the second surface, of the chamber is a non-planar surface.

3. A practice pad according to claim 2, wherein the non-planar surface is a domed surface, or an undulating surface.

4. A practice pad according to claim 3, wherein the plurality of elongate rods are arranged so as to extend across the one or more undulations of the undulating surface.

5. A practice pad according to claim 3, wherein the undulating surface is a corrugated surface.

6. A practice pad according to claim 1, wherein at least one of the first surface, and/or the second surface, of the chamber is metallic.

7. A practice pad according to claim 1, wherein the first and second surfaces of the chamber are configured to abut against the plurality of elongate rods with one or more of the plurality of elongate rods arranged in contact with both the first and second surfaces of the chamber.

8. A practice pad according to claim 1, wherein the practice pad includes a first panel that defines the second surface of the chamber.

9. A practice pad according to claim 8, wherein the practice pad includes a second panel that defines the first surface of the chamber.

10. A practice pad according to claim 9, wherein the first panel, the second panel and the plurality of elongate rods are individually movable with respect to one another in a first direction, extending from the first surface to the second surface of the chamber, and the first panel, the second panel and the plurality of elongate rods are configured to vibrate in that direction in response to a strike of the drum surface.

11. A practice pad according to claim 10, wherein the practice pad includes fastening elements configured to constrain the movement of the first panel with respect to the second panel, and thereby to retain the plurality of elongate rods between the first and second panels.

12. A practice pad according to claim 1, wherein the plurality of elongate rods are arranged substantially parallel to one another.

13. A practice pad according to claim 12, wherein the plurality of elongate rods are densely packed together, side-by-side, so as to press against one another inside the chamber.

14. A practice pad according to claim 1, wherein one or more of the plurality of elongate rods extends at least halfway across the first surface, and/or the second surface, of the chamber.

15. A practice pad according to claim 1, wherein the first surface of the chamber is an upper surface of the chamber arranged in a lateral plane, parallel to the drum surface, and the second surface of the chamber is an opposing lower surface of the chamber.

16. A practice pad according to claim 15, wherein at least one of the first surface, and/or the second surface, is concentric with the drum surface.

17. A practice pad according to claim 16, wherein at least one of the first surface, and/or the second surface, of the chamber extends under at least 50% of a lateral area defined by the drum surface.

18. A practice pad according to claim 1, wherein the sound generating device is arranged in a cavity of the practice pad, and wherein the cavity is defined by a recess in an underside of the practice pad.

19. A practice pad for practising the use of a snare drum, the practice pad comprising:

an upper drum surface; and a sound generating device arranged below the drum surface;

wherein the sound generating device includes:

a chamber having a first surface and an opposing second surface; and a plurality of elongate rods retained inside the chamber, between the first and second surfaces, so that the plurality of elongate rods vibrate against the first and second surfaces in response to a strike of the drum surface;

wherein at least one of the first surface, and/or the second surface, of the chamber is a corrugated surface including a plurality of undulations, and wherein the plurality of elongate rods are arranged so as to extend across the undulations of the corrugated surface.

20. A practice pad for practising the use of a snare drum, the practice pad comprising:

an upper drum surface; and a sound generating device arranged below the drum surface;

wherein the sound generating device includes:

a chamber having a first surface and an opposing second surface; and a plurality of elongate rods retained inside the chamber, between the first and second surfaces, so that the plurality of elongate rods vibrate against the first and second surfaces in response to a strike of the drum surface;

wherein the practice pad includes a first panel that defines the second surface of the chamber and a second panel that defines the first surface of the chamber;

wherein the first panel, the second panel and the plurality of elongate rods are individually movable with respect to one another in a first direction, extending from the first surface to the second surface of the chamber, and the first panel, the second panel and the plurality of elongate rods are configured to vibrate in that direction in response to a strike of the drum surface; and wherein the plurality of elongate rods are arranged substantially parallel to one another and the plurality of elongate rods are densely packed together, side-by-side, so as to press against one another inside the chamber.

* * * * *